US007003216B2

(12) United States Patent
Wagner

(10) Patent No.: US 7,003,216 B2
(45) Date of Patent: Feb. 21, 2006

(54) SPACE HEATER

(76) Inventor: Philip Gus Wagner, Box 103, Earl Grey, Saskatchewan (CA) S0G 1J0

( * ) Notice: Subject to any disclaimer, the term of this patent is extended or adjusted under 35 U.S.C. 154(b) by 7 days.

(21) Appl. No.: 10/868,760

(22) Filed: Jun. 17, 2004

(65) Prior Publication Data

US 2006/0002691 A1 Jan. 5, 2006

(51) Int. Cl.
*F17C 7/04* (2006.01)
*H05B 3/60* (2006.01)

(52) U.S. Cl. ..... 392/405; 392/314

(58) Field of Classification Search ..... 392/386, 392/394, 396, 397, 398, 403, 404, 405, 312, 392/360, 311, 313, 314, 324; 122/13.01; 165/48.1, 50, 58, 59, 60, 64, 66; 237/9 R, 237/19, 216
See application file for complete search history.

(56) References Cited

U.S. PATENT DOCUMENTS 1,182,688 A * 5/1916 Kirby ..... 392/378
1,322,761 A * 11/1919 Clark ..... 392/357
1,678,059 A 7/1928 D'Ardenne
2,151,140 A * 3/1939 Novak ..... 392/358
3,523,180 A 8/1970 Kennedy
3,681,567 A 8/1972 Boecher
3,952,182 A * 4/1976 Flanders ..... 392/466
3,973,479 A * 8/1976 Whiteley ..... 454/231
4,053,732 A 10/1977 Carter
4,362,090 A * 12/1982 Whiteley ..... 454/231
4,628,798 A 12/1986 Tagnon
5,299,278 A * 3/1994 Heller ..... 392/358

* cited by examiner

*Primary Examiner*—Sang Paik
(74) *Attorney, Agent, or Firm*—Ryan W. Dupuis; Adrian D. Battison; Michael R. Williams

(57) ABSTRACT

A portable space heater is provided in which a sealed vessel includes electrical heating elements for containing a fluid to be heated. A cooling tube communicates between an outlet at a top of the vessel and an inlet pipe extending down into the vessel. The inlet pipe includes an open top end for operating the vessel substantially at atmospheric pressure. A cooling fan directed at the cooling tube causes steam escaping from the outlet of the vessel to be condensed and returned at the inlet pipe. Plural independent electrical heating elements are provided for accurate control of heat output from the heater. The fan includes an inlet pipe extending upwardly thereabove for drawing air from the top of a space to be heated.

16 Claims, 2 Drawing Sheets

SPACE HEATER

FIELD OF THE INVENTION

The present invention relates to a space heater and more particularly relates to a portable heater in which an electrical heating element is used to generate steam for heating air in a heat exchanger device.

BACKGROUND

Various designs of portable space heaters are known in which electrical elements are used to generate steam for warming air by directing a fan to blow the air across a heat exchanger. Known steam heaters typically require a high pressure vessel in which the steam is generated in a closed loop system. High pressure vessels can be costly due to additional safety precautions that are required.

Examples of space heaters using electrical elements to generate steam include U.S. Pat. No. 1,678,059 to D'Ardenne, U.S. Pat. No. 3,523,180 to Kennedy, U.S. Pat. No. 3,681,567 to Boecher, U.S. Pat. No. 4,053,732 to Carter and U.S. Pat. No. 4,628,798 to Tagnon. In general the circulation of air provided by these heaters is often inadequate for evenly heating a large space and special consideration is required for accommodating pressure resulting from generation of steam. While Carter and Kennedy noted above disclose units for drawing air from above the unit adjacent a ceiling of a space to be heated, both mount the fan element adjacent a top end of the unit resulting in an unstable configuration which is not readily portable.

SUMMARY

According to one aspect of the present invention there is provided a space heater comprising:

- a sealed vessel for containing a fluid to be heated, including an outlet pipe in communication with a top end of the vessel and an inlet pipe extending down into the vessel in communication with the vessel at an open bottom end thereof, the inlet pipe having an open top end above the vessel;
- a cooling tube in communication between the outlet pipe and the inlet pipe;
- a fan directed at the cooling tube;
- a heating element supported within the vessel for heating fluid contained within the vessel.

The configuration in which the inlet pipe includes an open top end permits a low pressure vessel to be used because simply extending the inlet pipe down into the vessel to be submerged at the open bottom end thereof is sufficient for preventing excessive escape of steam from the heater. By locating a fan directly adjacent the cooling tube, the heater remains stable for portability even when a long intake pipe is provided above the fan.

The cooling tube preferably extends downwardly in a direction of flow from the outlet pipe to the inlet pipe of the vessel. The fan in this instance is preferably directed at the cooling tube adjacent a bottom end thereof nearest to connection with the inlet pipe.

The inlet pipe may extend upwardly from the vessel to the open top end thereof spaced well above the vessel. The inlet pipe many extend vertically between the open bottom end and open top end thereof. An indicator may then be readily floatably supported within the inlet pipe.

There may be provided a plurality of heating elements supported within the vessel for heating fluid contained within the vessel. The heating elements are preferably controlled independently of one another with at least one heating element includes a power rating which is different than the remaining heating elements to permit varying amounts of heat to be generated by the space heater.

When there is provided a fan housing surrounding the fan, an elongate inlet duct preferably extends upwardly above the fan housing a height which is plural times the height of the fan housing. Depending upon the height of the ceiling in the space to be heated, various heights of inlet ducts may be used, for example a height of eight feet may be used for the high ceiling in a warehouse or garage type environment, whereas in other applications a height only in the order of three feet may be desirable.

BRIEF DESCRIPTION OF THE DRAWINGS

In the accompanying drawings, which illustrate an exemplary embodiment of the present invention.

DETAILED DESCRIPTION

Figure 1:
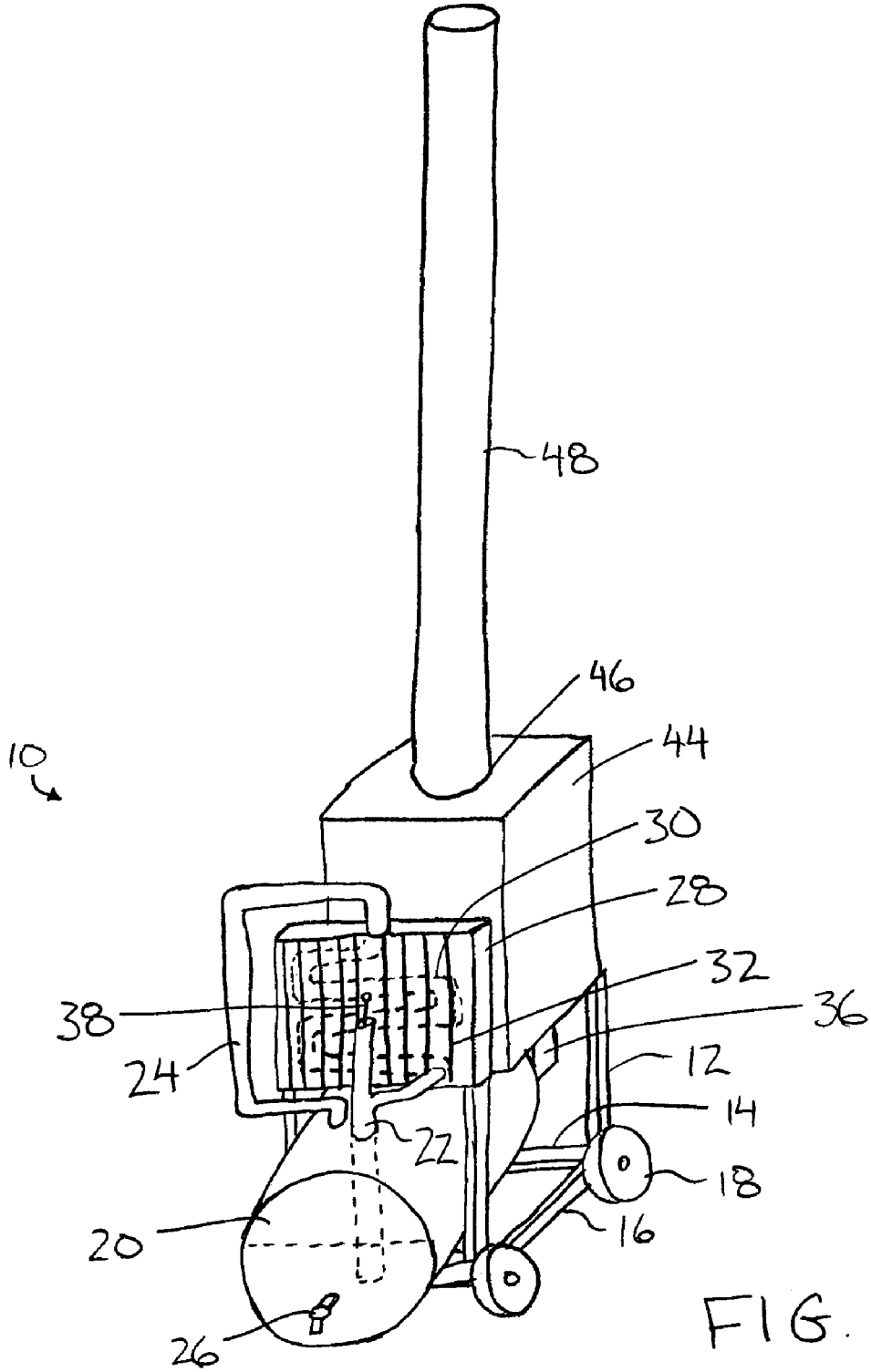
FIG. 1 is a perspective view of the portable heater according to the present invention.
Figure 2:
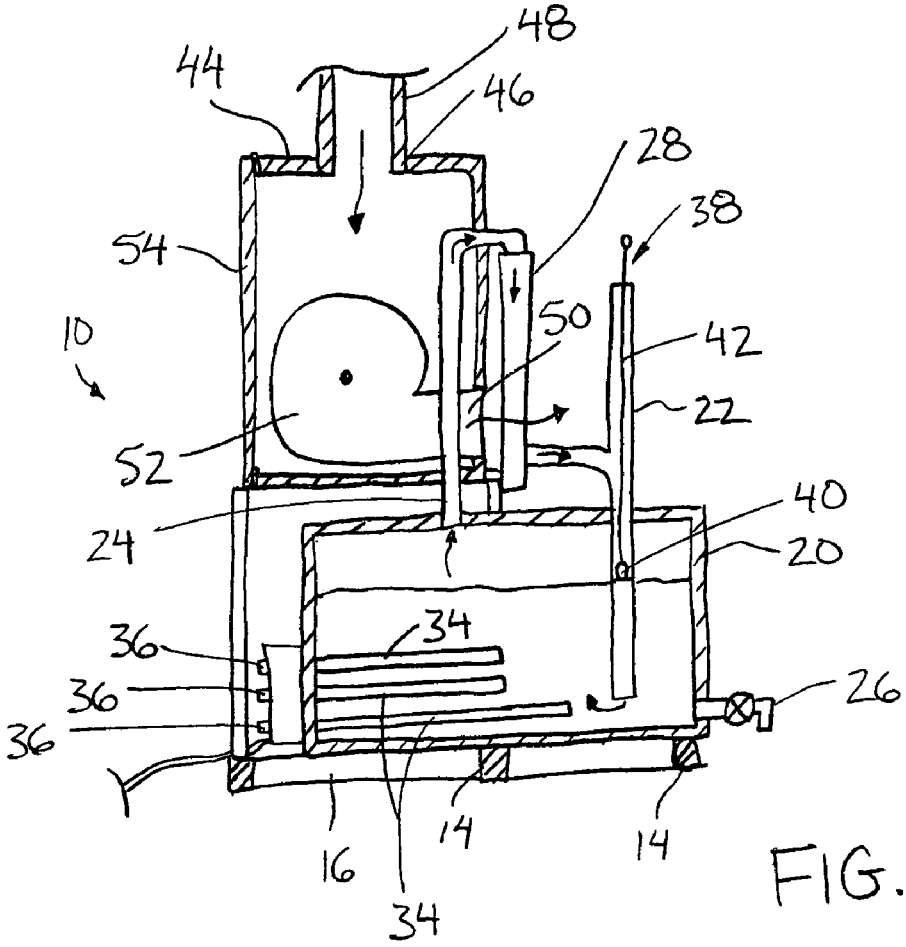
FIG. 2 is a partly sectional side elevational view of the vessel and fan housing.
Figure 3:
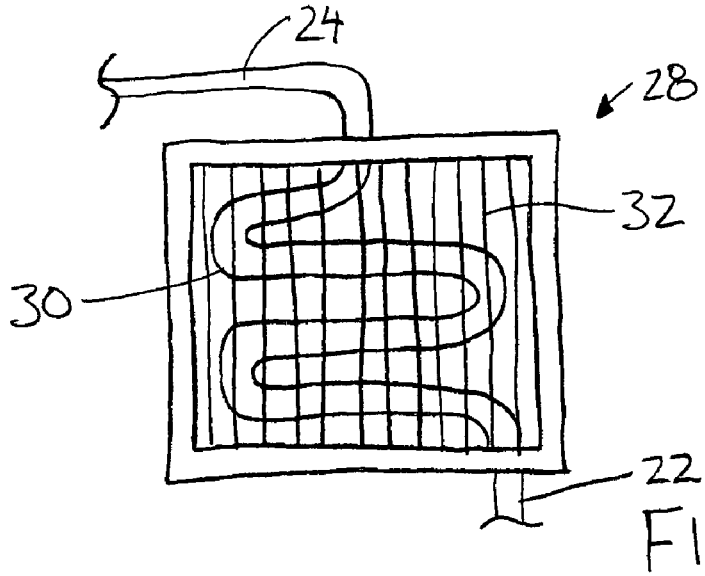
FIG. 3 is an elevational view of the cooling tube.

Referring to the accompanying drawings, there is illustrated a heater generally indicated by reference numeral 10. The heater 10 is a portable space heater which is ideal for temporary heating of large spaces, for example a garage or other large interior space.

The heater 10 includes a frame 12 formed of rigid metallic members which are appropriately fastened together for structural integrity. The base of the frame includes parallel and spaced apart rails 14 interconnected by a pair of parallel and spaced apart cross bars 16. The base of the frame is supported for rolling movement along the ground on a set of four wheels 18.

A tank 20 is supported on the rails 14 of the frame. The tank 20 generally comprises a cylindrical low pressure vessel which is fixed onto the frame 12. The tank 20 is sealed so as to be partly filled with water or other suitable heating fluid. A first opening is provided in the top of the tank 20 for receiving the inlet pipe 22 of the tank therethrough. Similarly a second opening is provided in the top of the tank 20 for communication with an outlet pipe 24 of the tank. Each of the pipes communicate through the tank wall with an interior of the tank. A drain valve 26 is provided at a bottom end of the tank 20 also for communication with an interior thereof.

The outlet pipe 24 communicates with the interior of the tank at the tank wall on the top end of the tank and does not extend inwardly into the tank, but rather extends upwardly above the tank. The inlet pipe 22 is a vertical section of pipe which extends downwardly into the tank within two or three inches of the bottom of the tank when a tank is provided which is approximately sixteen inches in diameter. The inlet pipe 22 also extends vertically upward above the tank a height which is approximately equal to the height in which it extends down into the tank. The inlet pipe includes an open top end vented to atmospheric pressure and an open bottom end which is intended to be submerged within the fluid in the tank in use.

A radiator 28 is provided which is supported above the tank 20 by rigid members of the frame 12. The radiator 28 generally comprises a cooling tube 30 surrounded by cooling fins 32 for radiating heat transferred from fluid passing through the cooling tube. The cooling tube lies in a generally common vertical plane and extends in a downward path from an inlet connected to the outlet pipe 24 at a top end of the radiator to an outlet end connected to the inlet pipe 22 of the tank adjacent a bottom end of the radiator. In this configuration the cooling tube 30 extends downwardly in the direction of flow of fluid therethrough until its point of connection with the inlet pipe at a location spaced above a level of fluid in the tank, and more particularly above the tank 20 itself. The cooling tube does connect to the inlet pipe directly adjacent the tank wall however and accordingly the inlet pipe 22 extends a considerable height above the point of connection with the cooling tube.

The fluid within the tank 20 is heated by three elements 34 in the form of electrical resistance heating elements. Among the elements 34, two of the elements are rated at 1000 watts each whereas a third one of the elements 34 is rated at 3000 watts. Each of the elements includes its own respective switch 36 for independently activating the heating elements by selecting which switches 36 are actuated.

Any steam lost through the inlet pipe due to heating by the heating elements 34 is monitored by a float indicator 38 provided in the inlet pipe. The float indicator includes a ball float 40 at a bottom end thereof which floats within the inlet pipe at a height corresponding to height of fluid within the tank. An elongate stem 42 extends upwardly through the inlet pipe a height which is greater than the overall height of the inlet pipe. Depth markings are provided at spaced positions along the stem 42 for indicating to the operator the approximate height of the water within the tank.

A fan housing 44 is also supported on the frame 12 of the heater, directly adjacent the radiator 28 above the tank 20. The fan housing is an enclosed chamber having an inlet 46 at a top end for connection with a supply air duct 48 and an outlet duct 50 in the form of an opening adjacent a bottom end of the fan housing directly adjacent the radiator at a point in the cooling tube nearest to its connection with the inlet pipe.

A fan 52 is located within the fan housing along with a respective motor to drive the fan 52 in a manner in which pressurized air from the fan is directed at the radiator 28 through the outlet opening in the fan housing. The fan and outlet opening in the fan housing are oriented and positioned directly adjacent the tank and the radiator 28 so that the air from the fan is concentrated on the cooling tube 30 at a bottom end thereof nearest to its point of connection with the inlet pipe 22. The fan housing 44 further includes an access door 54 in the form of a hinged panel opposite the radiator 28 to selectively permit access to the fan 52 and associated motor as required.

The supply air duct 48 is a tubular duct which extends vertically upwardly from the inlet 46 of the fan housing a height which is in the order of approximately eight feet. Accordingly the height of the air supply duct 48 is plural times the height of the fan housing or the radiator, such that the open top end of the duct is positioned considerably higher above the fan housing.

By supporting the heater on a set of wheels, the tank, the radiator and the fan housing are readily portable for temporary heating of various spaces. The tank is approximately twenty-two inches in length and sixteen inches in diameter. The tank is filled by pouring water into the inlet pipe and can be drained for servicing by use of the drain valve 26. Water is filled within the tank to a sufficient height that the bottom of the inlet pipe remains submerged even after considerable amount of use has taken place. The inlet pipe extends approximately sixteen inches above the tank and receives the float indicator through the open top end thereof for indicating the height of liquid within the tank. A small section of horizontal pipe is provided between the bottom of the cooling tube extending through the radiator and the inlet pipe at a location directly above the tank. The outlet pipe also extends upwardly from the tank a considerable height for connection to the top end of the cooling tube of the radiator.

The fan housing and corresponding ducts are arranged such that the fan blows air to concentrate on the bottom corner of the radiator at which point the cooling tube exits the radiator to ensure that the steam passing through the cooling tube is sufficient cooled to be condensed for returning back into the tank by means of the inlet pipe connection.

In use the long supply air duct 48 draws air from close to the ceiling of a space to be heated so that this air can be blown through the radiator for optimal circulation of air in a space to be heated to evenly heat all parts of the space. Maintenance only involves the addition of minimal water to compensate for minimal evaporation occurring through the open top end of the inlet pipe. The appropriate time to be filling water in the tank is readily indicated by the float indicator in the inlet pipe.

Depending upon the level of heat required one or all of the heating elements can be activated by actuating the respective switches thereof.

While one embodiment of the present invention has been described in the foregoing, it is to be understood that other embodiments are possible within the scope of the invention. The invention is to be considered limited solely by the scope of the appended claims.

I claim:

1. A space heater comprising:

a sealed vessel for containing a fluid to be heated, including an outlet pipe in communication with a top end of the vessel and an inlet pipe extending down into the vessel in communication with the vessel adjacent a bottom end of the vessel at an open bottom end of the inlet pipe, the inlet pipe having an open top end above the vessel which is vented to atmosphere;

a cooling tube in communication between the outlet pipe and the inlet pipe, extending downwardly in a direction of flow from the outlet pipe to the inlet pipe of the vessel;

a fan directed at the cooling tube; and a heating element supported within the vessel for heating fluid contained within the vessel.

2. The heater according to claim 1 wherein the fan is directed at the cooling tube adjacent a bottom end thereof nearest to connection with the inlet pipe.

3. The heater according to claim 1 wherein the inlet pipe extends upwardly from the vessel to the open top end thereof spaced above the vessel.

4. The heater according to claim 3 wherein there is provided an indicator floatably supported within the inlet pipe.

5. The heater according to claim 3 wherein the inlet pipe extends vertically between the open bottom end and open top end thereof.

6. The heater according to claim 1 wherein there is provided a plurality of heating elements supported within the vessel for heating fluid contained within the vessel.

7. The heater according to claim 6 wherein the heating elements are controlled independently of one another.

8. The heater according to claim 6 wherein at least one heating element includes a power rating which is different than the remaining heating elements.

9. The heater according to claim 1 wherein there is provided a fan housing surrounding the fan which includes an elongate inlet duct extending upwardly above the fan housing.

10. The heater according to claim 9 wherein the inlet duct has a height which is plural times the height of the fan housing.

11. The heater according to claim 9 wherein a height of the inlet duct is at least three feet.

12. The heater according to claim 9 wherein the height of the inlet duct is approximately eight feet.

13. A space heater comprising:

a sealed vessel for containing a fluid to be heated, including an outlet pipe in communication with a top end of the vessel and an inlet pipe in communication with a bottom end of the vessel at an open bottom end of the inlet pipe, the inlet pipe being vented to atmosphere at an open top end above the vessel;

a cooling tube in communication between the outlet pipe and the inlet pipe, extending downwardly in a direction of flow from the outlet pipe to the inlet pipe;

a fan directed at the cooling tube;

a heating element supported within the vessel for heating fluid contained within the vessel; and an elongate indicator floatably supported within the inlet pipe, including depth markings at spaced positions therealong for indicating a height of fluid within the tank.

14. The heater according to claim 13 wherein the indicator extends through the open top end of the inlet pipe.

15. The heater according to claim 13 wherein the inlet pipe extends vertically between the open bottom end and open top end thereof.

16. A space heater comprising:

a sealed vessel for containing a fluid to be heated, including an outlet pipe in communication with a top end of the vessel and an inlet pipe in communication with a bottom end of the vessel at an open bottom end of the inlet pipe;

a cooling tube in communication between the outlet pipe and the inlet pipe, extending downwardly in a direction of flow from the outlet pipe to the inlet pipe;

a fan directed at the cooling tube; and a heating element supported within the vessel for heating fluid contained within the vessel;

wherein the inlet pipe extends upwardly from a point of communication with the cooling tube to a top end of the inlet pipe which is spaced above the vessel and which is open and vented to atmosphere.

* * * * *